United States Patent [19]

Valencia

[11] 4,276,850

[45] Jul. 7, 1981

[54] APPARATUS TO AID IN THE DOCKING AND MOORING OF A BOAT

[76] Inventor: C. Estaban Valencia, 495 Mariposa Dr., Ventura, Calif. 93003

[21] Appl. No.: 89,283

[22] Filed: Oct. 29, 1979

Related U.S. Application Data

[63] Continuation-in-part of Ser. No. 916,267, Jun. 16, 1978, abandoned.

[51] Int. Cl.[3] ..... B63B 21/00

[52] U.S. Cl. ..... 114/230; 114/221 R; 114/249; 294/19 R

[58] Field of Search ..... 114/221 R, 230, 231, 114/249, 250, 252; 294/19 R, 20, 84

[56] References Cited

U.S. PATENT DOCUMENTS

| | | | |
|---|---|---|---|
| 3,196,824 | 7/1965 | Howard | 114/230 |
| 3,224,404 | 12/1965 | DeJong | 114/230 |
| 3,793,685 | 2/1974 | Knecht | 114/230 |
| 3,818,854 | 6/1974 | Marriner | 114/249 |
| 3,913,515 | 10/1975 | Hernsjo et al. | 114/230 |
| 3,949,699 | 4/1976 | Heese et al. | 114/249 |
| 4,079,690 | 3/1978 | Paul | 114/230 |
| 4,143,613 | 3/1979 | Paul | 114/221 R |

*Primary Examiner*—Charles E. Frankfort
*Attorney, Agent, or Firm*—Jack C. Munro

[57] ABSTRACT

An apparatus to aid in the docking and mooring of a boat which employs a fixed housing which has an opening found therein. A latching pawl assembly connects with the opening and is movable between a latching position and an unlatching position. A funnel shaped shield is located about the opening. A rod member which comprises a front end of an elongated pole is to be guided by the shield into connection with the opening and to be latched by the latching pawl assembly. Pushing and pulling movements can then be exerted against the pole to ease a small boat against a pier.

2 Claims, 9 Drawing Figures

Fig. 6
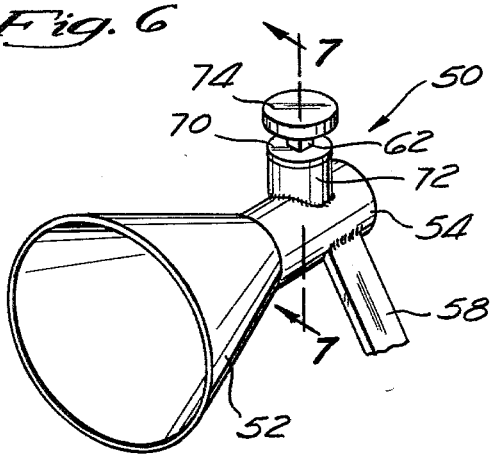
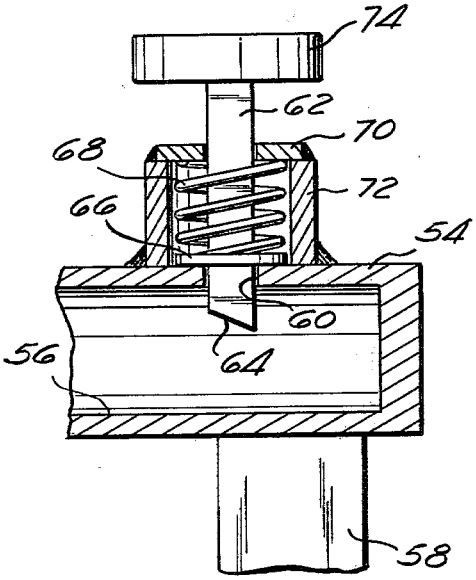
Fig. 7
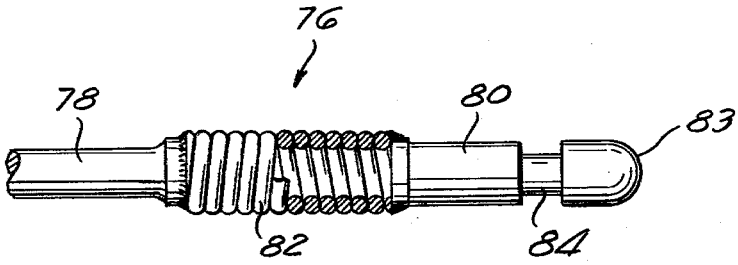
Fig. 8
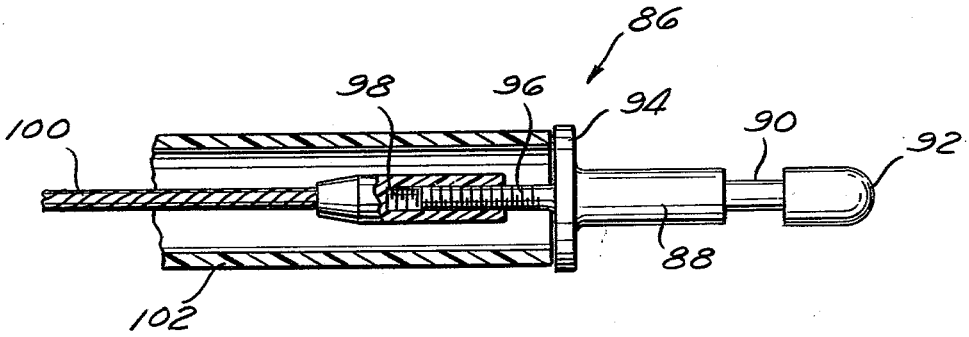
Fig. 9

APPARATUS TO AID IN THE DOCKING AND MOORING OF A BOAT

REFERENCE TO PRIOR APPLICATION

This patent application is a continuation-in-part of patent application Ser. No. 916,267, filed June 16, 1978 with the same title and by the present inventor, now abandoned.

BACKGROUND OF THE INVENTION

The field of this invention relates to a device to ease a small boat against a pier prior to mooring of the boat.

Operators of small pleasure craft, both sail and power, have long been faced with the problem of safely and easily bringing their boats to a stop directly adjacent a dock, pier or piling and then mooring or securing the boat thereto with suitable mooring lines. It is particularly difficult to manuever a small sail boat without power or even a small power boat with only a single engine in close quarters at slow speeds where steerage is severely limited. In many instances it requires the presence of a person on the dock to receive a line thrown from the boat or to throw a line to someone on the deck of the boat to assist in bringing the boat safely to the dock.

There are multiple hazards to the foredeck hand who attempts to fend a moving boat off of a dock when the boat is moving too fast to safely dock. There are also hazards involved when a person leaps from the deck of the boat to the dock and attempts to handle an approaching boat. And, of course, even with all hands safe, if the boat is traveling too fast, there is a risk of substantial serious damage either to the hull of the craft or to the dock or pier in the event of a collision.

The prior art has generally provided either a loose line, which one can cast or throw either to someone on the dock or attempt to loop around a projecting pylon or piling, and thereby have a means for securing the boat. However, a loose line provides no means for fending off the boat if the boat is moving at too high a rate of speed into contact with the pier.

Additionally, many boats are equipped with boat hooks which are long handled devices with which one can grapple for either the pier or the piling and/or fend the boat off the pier. However, it is common for the end of the boat hook to slip off of the piling or the pier and the boat then strongly bumps the pier or piling. This contact with the pier is undesirable, not only from a point that the paint of the boat may be scratched and removed, but also that the boat structure itself can be damaged.

A common hazard which frequently occurs in the guiding of a boat into a pier is that the person reaching for the pier may be caused to fall into the water. It seems as though when a man and a woman are in the boat together, it is usually the man at the helm of the boat and the woman is the person grabbing for the pier. If this occurs in colder climates where the water can be quite cold, it can only take a few minutes before the person can be caused to go into shock from the coldness of the water. Women seem to be more sensitive to this than men, and it is ironic that in most instances they are the persons who are reaching for the pier. Additionally, older people and specifically older women, are extremely sensitive to cold water. It is not at all uncommon for an older woman to go into shock and actually die before the lady can be pulled from the water. There is a definite need for a simple and effective device which could be used by even the most unskilled person to aid in the docking and mooring of a small pleasure boat.

SUMMARY OF THE INVENTION

The present invention has a new and improved apparatus which enables a deckhand to quickly, easily and accurately ease a boat into its docking location. The deckhand has the option of supplying force to pull the boat toward the pier or to exert a force tending to slow the boat's movement toward the pier.

The apparatus of this invention is to be employed in conjunction with an elongated pole, usually eight or ten feet in length, in which the outer end of the pole is formed in the shape of a thin rod member, the outer end of which is slightly enlarged. With a boat coming into close proximity to the pier, the deckhand is to locate the outermost end of the pole into a funnel shaped shield of the apparatus of this invention. The shield is to guide the outermost end of the pole into an opening formed within a housing. The housing has been fixedly secured to a piling, pier or other fixed structure. Within the opening is located a latching pawl assembly. The outermost end of the pole becomes locked by the latching pawl assembly to the housing. The locked pole can then become disassociated from the apparatus by manually releasing the latching pawl assembly.

BRIEF DESCRIPTION OF THE DRAWINGS

FIG. 6 is an isometric view of a modified form of funnel shaped boat docking and mooring apparatus of this invention;

FIG. 7 is a cross-sectional view taken through line 7—7 of FIG. 6;

FIG. 8 is an elevational view of the pit portion of a desirable form of rod assembly which is to cooperate with the apparatus of FIG. 6; and FIG. 9 is a view similar to FIG. 8 but of a second embodiment of the rod assembly which is to be usable in connection with the apparatus shown in FIG. 6.

DETAILED DESCRIPTION OF THE SHOWN EMBODIMENT

Figure 1:
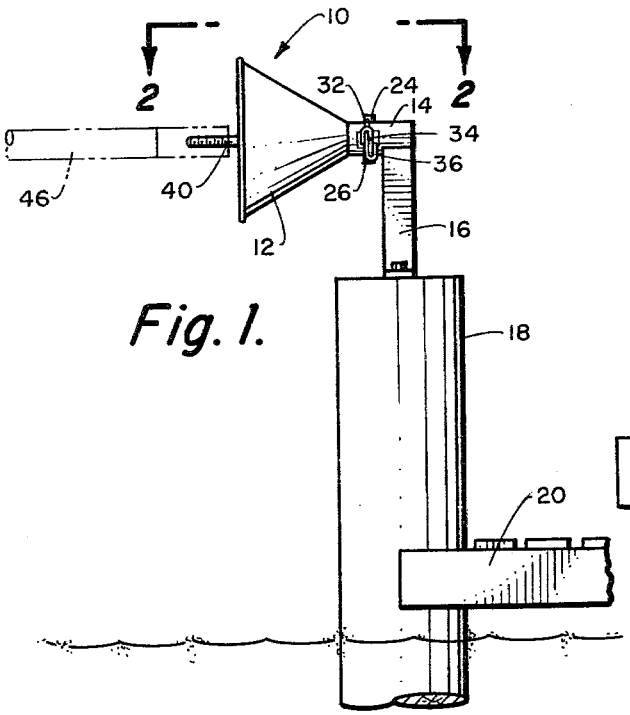
FIG. 1 is a side-elevational view of the apparatus of this invention showing this connection with an elongated pole member.

Referring particularly to the drawing, there is shown in FIG. 1 an apparatus 10 of this invention which generally takes the form of a funnel shaped shield 12 which is fixedly secured to a housing 14. A bracket 16 secures the housing 14 to a fixed structure such as a piling 18. The piling 18 is shown attached to a pier 20.

Formed within the housing 14 is an opening 22. The opening 22 has an enlarged open front end and a closed back end. The sidewalls of the opening 22 are tapered inwardly to where the general configuration of the opening 22 is that of a cone.

Connecting with the opening 22 is a latching pawl assembly which takes the form of a pair of latching pawls 24 and 26. The latching pawl 24 is slidably mounted within a hole 28 formed within the housing 14. The latching pawl 26 is slidably mounted within a hole 30 formed within the housing 14. The latching pawls 24 and 26 are shown located diametrically opposite each other in a facing relationship. It is considered to be within the scope of this invention that the placement of the latching pawls 24 and 26 could be varied, or a single latching pawl employed, or a greater number of latching pawls employed.

Figure 4:
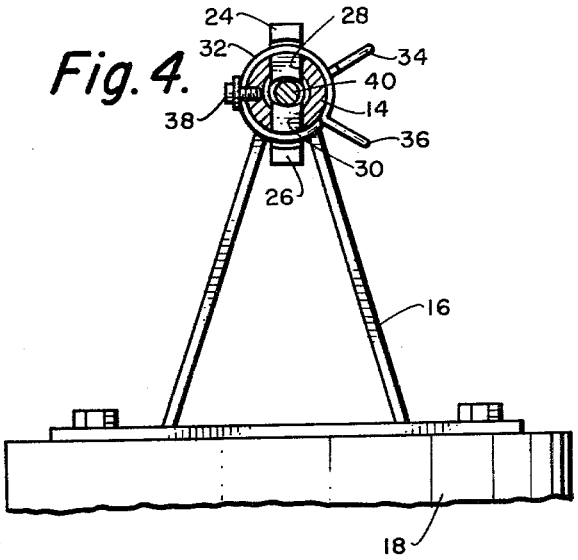
FIG. 4 is a cross-sectional view through the latching pawl assembly included within the apparatus of this invention taken along line 4—4 of FIG. 2.
Figure 2:
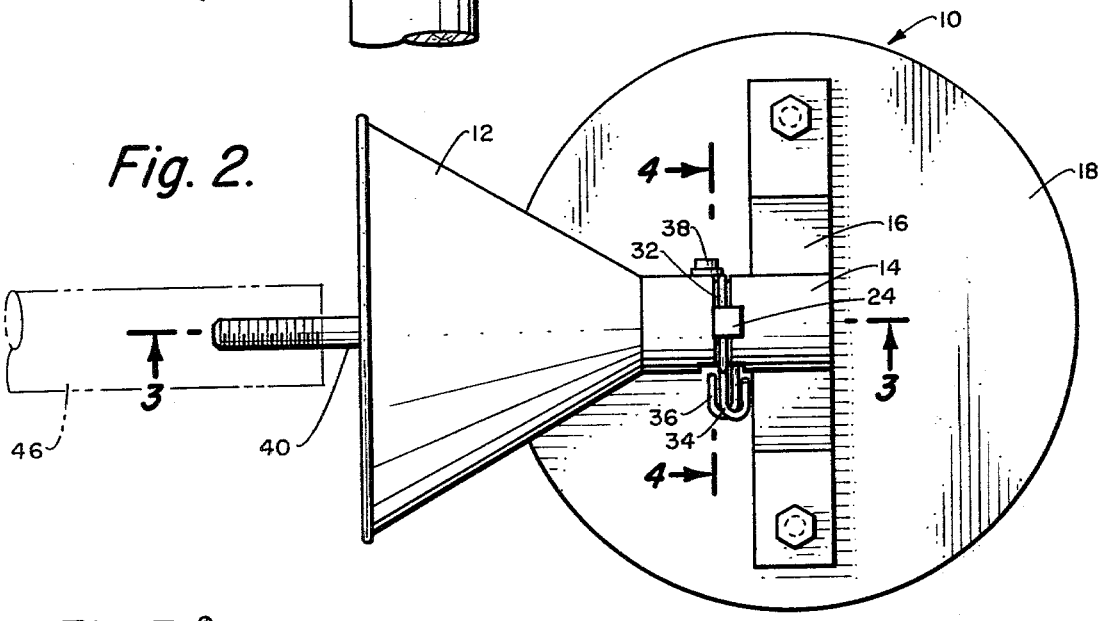
FIG. 2 is a top plan view of the apparatus of this invention taken along line 2—2 of FIG. 1.
Figure 3:
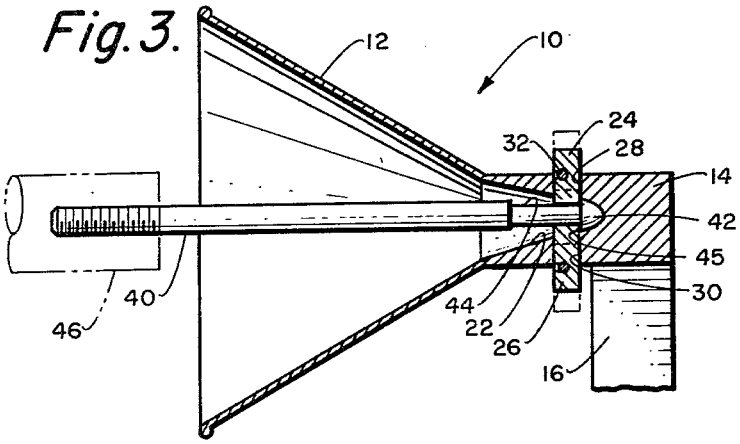
FIG. 3 is a side cross-sectional view of the apparatus of this invention taken along line 3—3 of FIG. 2.
Figure 5:
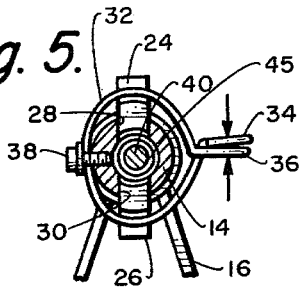
FIG. 5 is a segment of a cross-sectional view similar to FIG. 4 showing the latching pawl assembly in the unlatched position.

Each of the latching pawls 24 and 26 connect with a wire member 32. The wire member 32 is circular shaped and is located about the housing 14. The free ends 34 and 36 are normally located in a spaced apart manner as shown in FIG. 4 of the drawings. FIG. 4 is the at rest position for the wire member 32. It is to be understood that the wire member 32 is inherently spring biased. The wire member 32, at approximately the midpoint between the ends 34 and 36, is fixedly secured by a fastener 38 to the housing 14. By moving together the ends 34 and 36, as shown in FIG. 5 of the drawings, the latching pawls 24 and 26 are moved in an outward direction and are no longer associated with the opening 22.

The funnel shaped shield is fixedly secured to the housing 14 about the front end of the opening 22. An elongated rod member 40 has a rounded head 42. A portion of the rod 40 is cut to a smaller diametered section 44 just rearwardly of the head 42. Therefore, the back side 44 of the head 40 forms an annular shaped flange. The rod 40 is to form the outermost end of an elongated pole 46.

The operation of the apparatus 10 of this invention is as follows: The pole 46 will be carried upon the boat (not shown). The apparatus 10 is fixedly mounted on the piling 18 located adjacent to pier 20. As the boat moves closer to the pier 20 and comes into close proximity thereto, a deckhand manually grabs the pole 46 and extends such outwardly attempting to locate the rod 40 internally of the shield 12. All that is necessary is that the deckhand locate the rod 40 within the enlarged outer end of the shield 12. It is to be noted that the rod 40 can enter the shield 12 from any direction defined by the angle of the shield 12.

The deckhand then merely thrusts forward the pole 46 which causes the enlarged head 42 to move along the inside surface of the shield 12 and into the opening 22. As the head 42 continues to move within the opening 22 and contact the latching pawls 24 and 26, these pawls are moved outwardly by the rounded camming surface of the head 42. With the head 42 located in physical contact with the back closed end of the opening 22, the latching pawls 24 and 26 are permitted to move again to the latching position caused by the bias of the wire member 32. In this latched position, the latching pawls 24 and 26 are in physical contact with the flange 44 thereby securing the rod 40 to the housing 14. It is now impossible to disassociate the rod 40 from the housing 14 and the deckhand can push against the pole 46 or pull on the pole 46 in order to locate the boat directly against the pier 20.

It is to be noted that although it is not possible to disassociate the rod 40 from the housing 14, the rod 40 is movable to assume different angular positions with respect to the shield 12. This amount of movement is necessary since contact with the apparatus 10 will not always occur from the same direction, and also during locating of the boat adjacent the pier 20 the position of the pole 46 with respect to the device 10 will vary.

Once the boat is positioned adjacent the pier 20, the deckhand can then employ a conventional tiedown means to moor the boat to the piling 18 or other pilings not shown. Once the boat has been moored, the deckhand merely matingly moves together the ends 36 and 34 of the member 32 which causes the latching pawls 24 and 26 to move to the unlatched position and permits disassociation of the member 40 from the device 10. The device 10 is then ready to be reused. Due to release of the ends 34 and 36, the inherent spring bias of the member 32 will move the latching pawls 24 and 26 back to the latched position.

Referring particularly to FIG. 6 of the drawings, there is shown a modified form of apparatus 50 of this invention. The apparatus 50 takes the form of a funnel shaped shield 52 which is fixedly secured to a housing 54. The housing 54 is hollow and includes an internal chamber 56. An exterior portion of the housing 54 is attached by means of a bracket 58 to a fixed structure such as a piling 18. The interior chamber 56 has a closed back end and an open front end which connects with the interior of the shield 52. It is to be noted that in the embodiment in FIG. 6, the side walls of the interior chamber 56 are not tapered as is the case in the embodiment of FIGS. 1–5.

Formed through the side wall of the housing 54 is a hole 60. A latching pawl 62 extends through the hole 60. The latching pawl 62 includes a beveled cam surface 64. Spaced from the cam surface 64 there is fixedly secured to the latching pawl 62 a washer 66. A coil spring 68 is in contact with the washer 66. The free end of the spring 68 abutts a plate 70. The plate 70 is formed as part of a boss 72. The boss 72 surrounds the coil spring 68. The coil spring 68 exerts a continuous bias against the latching pawl 62 tending to locate the washer 66 in contact with the housing 54. This is the maximum extending position of the latching pawl 62.

Upon insertion of the rod 40 into the interior chamber 56, the head 42 contacts the beveled surface 64 and further insertion of the rod 40 causes the latching pawl 62 to move upwardly against the bias of the spring 68 until the latching pawl 62 connects with the smaller diametered section 44. At this particular time, withdrawal of the rod 40 is then prevented. Upon manual grasping of knob 74 and moving of the latching pawl 62 against the bias of the spring 68, only then can the rod 40 be removed from the interior chamber 56.

Noting in particular FIG. 8 of the drawings, there is shown a modified form of rod 76 which includes a main body section 78 and a head section 80. Integrally, or fixedly secured between the head section 80 and the main body section 78 is a tightly wound coil spring 82. The coil spring 82 permits flexing of the head 80 with respect to the main body section 78. Therefore, it would not be necessary to have the head portion 80 enter directly into the interior of the shield 52. Actually, as long as the operator can cause the head portion 80 to enter within the interior of the shield 52, the head portion 80 can bend with respect to the main body portion 78 in order to facilitate entry into the interior chamber 56. Once the head portion 80 has entered the interior chamber 56, the tip portion 83 will operate against the beveled surface 64, which then will cause the latching pawl 62 to connect with the smaller diametered portion 84.

Noting in particular FIG. 9 of the drawings, there is shown a second embodiment 86 of pole 46 which provides for a head portion 88, which includes a smaller diametered section 90 and a tip portion 92. The head portion 88 is attached to an enlarged flange 94. Centrally connected to the back end of the flange 94 is a screw thread 96. The screw thread 96 is threadingly engaged to an elongated nut 98. The nut 98 is fixedly secured to a cable 100. It would normally be preferable to construct the cable 100 of a plastic sheathed material.

The main feature of the embodiment 86 is that it can be coiled and stored in substantially a smaller space than a solid elongated rod. Also, once the head 88 is installed within the interior chamber 56, the cable 100 functions like a rope which is more convenient than an elongated rod.

In order to install the head 88 within the interior chamber 56, the operator first conducts the cable 100 through an elongated tube 102. The length of the tube 102 is optional and can normally be six feet to eight feet long. The end of the tube 102 abutts the flange 94. Therefore, with the end of the cable 100 extending out of the back end of the tube 102, the operator then has, for all practical purposes, a solid pole. This solid pole is necessary in order to install the head 88 within the interior chamber 56. Once the head 88 is properly installed within the interior chamber 56, the operator then removes the tube 102 and employes the use of the cable 100 as a rope.

What is claimed is:

1. An apparatus to aid in the docking and mooring of a boat comprising:

a housing adapted to be secured to a fixed structure such as a piling, pier or the like;

an opening formed within said housing, said opening having an open front end;

guiding means connected to said housing and located about said opening, said guiding means adapted to direct a free end of an elongated member into said opening when such is moved in close proximity to said opening, said guiding means having an enlarged open outer end, said guiding means being in the shape of a funnel;

a latching means mounted on said housing connecting with said opening, said latching means being movable in respect to said opening between a latched position and an unlatched position, said latched position being when said latching means extends into said opening and said unlatched position being when said latching means is displaced from said opening, said latching means when at rest being normally located in said latched position, said latching means being continuously spring biased to said latched position;

actuation means to manually move said latching means from said latched position to said unlatched position;

an elongated member the free end of which is to be locatable within said opening, said free end being rigid, said latching means to connect with said free end of said elongated member in said latching position and secure said elongated member to said housing, said free end of said elongated member to be disconnectable from said housing, said elongated member being disconnected from said boat and adapted to be hand held by an occupant of said boat; and said elongated member having an enlarged abutment means adjacent said free end, a lanyard means being attached to said abutment means and extending rearwardly therefrom, a tubular member having an end thereof engaging said abutment means and having an internal chamber, said lanyard means to be located within said internal chamber and to contact said abutment means, the cross-sectional area of said lanyard means being substantially smaller than the cross-sectional area of said internal chamber, said lanyard means to extend entirely through said tubular member, said tubular member to be readily disengaged from said abutment means and said lanyard means to be removed from said internal chamber of said tubular member with said tubular member to be then put aside and said lanyard means used by a boat occupant to move the boat to the mooring position.

2. The apparatus as defined in claim 1 wherein:

said lanyard means takes the form of a cable.

* * * * *

UNITED STATES PATENT AND TRADEMARK OFFICE

CERTIFICATE OF CORRECTION

PATENT NO. : 4,276,850

DATED : July 7, 1981

INVENTOR(S) : C. Esteban Valencia

It is certified that error appears in the above—identified patent and that said Letters Patent is hereby corrected as shown below:

On the Title page, the inventor's name should read --C. Esteban Valencia--.

Signed and Sealed this

*Fifteenth* Day of *December 1981*

[SEAL]

*Attest:*

GERALD J. MOSSINGHOFF

*Attesting Officer*

*Commissioner of Patents and Trademarks*